US010041209B1

(12) United States Patent
Cowan et al.

(10) Patent No.: US 10,041,209 B1
(45) Date of Patent: Aug. 7, 2018

(54) SYSTEM FOR ENGINEERING FIBERS TO IMPROVE PAPER PRODUCTION

(71) Applicant: Pulmac Systems International, Inc., Williston, VT (US)

(72) Inventors: Joffrey Dard Cowan, South Burlington, VT (US); Wavell Frederick Cowan, Montpelier, VT (US); Robert Joseph White, Williston, VT (US)

(73) Assignee: Pulmac Systems International, Inc., Williston, VT (US)

( * ) Notice: Subject to any disclaimer, the term of this patent is extended or adjusted under 35 U.S.C. 154(b) by 0 days.

(21) Appl. No.: 15/242,501

(22) Filed: Aug. 20, 2016

Related U.S. Application Data

(60) Provisional application No. 62/208,355, filed on Aug. 21, 2015.

(51) Int. Cl.
*D21D 5/24* (2006.01)
*D21G 9/00* (2006.01)
(Continued)

(52) U.S. Cl.
CPC ..... *D21D 5/24* (2013.01); *D21D 1/20* (2013.01); *D21G 9/0018* (2013.01); *G01N 29/036* (2013.01); *G01N 2291/02416* (2013.01)

(58) Field of Classification Search
CPC .. D21D 5/18; D21D 5/20; D21D 5/22; D21D 5/24
See application file for complete search history.

(56) References Cited

U.S. PATENT DOCUMENTS 3,802,964 A 4/1974 Forgacs et al.
3,873,416 A 3/1975 Forgacs et al.
(Continued)

FOREIGN PATENT DOCUMENTS

CN 102242511 A 11/2011
DE 102006020215 A1 11/2007
(Continued)

OTHER PUBLICATIONS

Tappi, Consistency Measurment and Control in a Tissue Mill, 2011, PaperCon.*
(Continued)

*Primary Examiner* — Anthony Calandra
(74) *Attorney, Agent, or Firm* — Thomas G. Ference

(57) ABSTRACT

A system for treating cellulosic fibers to improve paper, board and tissue quality; the system involves splitting fibers into an original portion having original fibers and a refinable portion. The refinable portion may further be fractionated by one or more fibers properties by a fiber fractionation system into a first fraction and a second fraction. The refinable portion as a whole, or a fractionated fraction thereof, is then refined to produce refined fibers. Varying amounts of the original unrefined fibers, refined fibers and possibly additionally fractionated unrefined fibers are blended together to form an optimized slurry that is processed by a paper machine into an optimized paper product. A master control system, fiber measurement system and optional fractionation maintenance system are integrated with the overall system to regulate all processing.

41 Claims, 19 Drawing Sheets

(51) Int. Cl.
*D21D 1/20* (2006.01)
*G01N 29/036* (2006.01)

(56) References Cited

U.S. PATENT DOCUMENTS

| | | | | |
|---|---|---|---|---|
| 4,292,122 | A | 9/1981 | Karnis et al. | |
| 4,342,618 | A | 8/1982 | Karnis et al. | |
| 4,562,969 | A | 1/1986 | Lindahl | |
| 4,704,201 | A | 11/1987 | Keck et al. | |
| 4,776,926 | A | 10/1988 | Lindahl | |
| 4,886,576 | A | 12/1989 | Sloan | |
| 4,892,619 | A | 1/1990 | Tistad | |
| 5,131,980 | A | 7/1992 | Chamlee et al. | |
| 5,133,832 | A | 7/1992 | Gilkey | |
| 6,361,650 | B1 | 3/2002 | Danielsson et al. | |
| 6,440,272 | B1 | 8/2002 | Binder et al. | |
| 6,491,792 | B2 | 12/2002 | Shakespeare et al. | |
| 6,517,680 | B1 * | 2/2003 | Fredlund | D21F 1/66 162/130 |
| 6,746,572 | B2 | 6/2004 | Schwartz | |
| 6,846,381 | B2 | 1/2005 | Jussila et al. | |
| 7,077,930 | B2 | 7/2006 | Ammala et al. | |
| 7,083,049 | B2 | 8/2006 | Schabel | |
| 7,381,295 | B2 | 6/2008 | Kokkonen | |
| 7,407,563 | B2 | 8/2008 | Hietaniemi | |
| 7,972,476 | B2 | 7/2011 | Scherb et al. | |
| 8,262,860 | B2 * | 9/2012 | Ring | D21C 7/12 162/252 |
| 8,679,293 | B2 | 3/2014 | Ding et al. | |
| 8,764,936 | B2 | 7/2014 | Laurila-Lumme et al. | |
| 8,877,010 | B2 | 11/2014 | Saren | |
| 8,926,793 | B2 | 1/2015 | Goto et al. | |
| 9,039,272 | B2 | 5/2015 | Karki | |
| 2004/0011483 | A1 | 1/2004 | Hautala et al. | |
| 2006/0289140 | A1 | 12/2006 | Park et al. | |
| 2008/0029232 | A1 | 2/2008 | Wikdahl et al. | |
| 2009/0301674 | A1 | 12/2009 | Niinimaki et al. | |

FOREIGN PATENT DOCUMENTS

| | | | | |
|---|---|---|---|---|
| EP | 1889971 | A1 | 2/2008 | |
| EP | 2009176 | A2 | 12/2008 | |
| WO | WO 9107231 | A1 * | 5/1991 | B04C 5/22 |
| WO | 2006108508 | A1 | 10/2006 | |
| WO | 2007063182 | A2 | 6/2007 | |
| WO | 2009000348 | A1 | 12/2008 | |
| WO | 2009077001 | A1 | 6/2009 | |

OTHER PUBLICATIONS

Smook, Handbook for Pulp and Paper Technologists, 1992, Angus Wilde Publications, 2nd edition, chapter 9.*

Eglish language summary of foreign patents cited in Dec. 15, 2017 IDS from www.espacenet.com, Jan. 4, 2018.*

* cited by examiner

Fiber Fractionation System
(34, 34a)

Fiber Fractionation System
(34, 34b)

Fiber Fractionation

Thin Walled Fiber

Thick Walled Fiber

Fiber Wall Thickness Measurment with RGB Circular Polarized Light

Fiber Wall Thickness Distribution of Fractionated Pulp

Fiber Refining

Crill Measurment $$\text{Crill Bonding Area} = \frac{\text{UV Absorption}}{\text{IR Absorption}}$$

Crill Bonding Area Before and After Refining

Vibration Spectra and Characteristic

Static Fiber Processing Flow
Example 1

Dynamic Fiber Processing Flow
Example 2

System for Engineering Fibers
to Improve Paper Production
(20, 20b)

Static Fiber Processing Flow
Example 3

Dynamic Fiber Processing Flow
Example 4

Exemplary Process Parameters
Table 1

| System | Samples | Fractionation | % Mixtures | | Refining |
|---|---|---|---|---|---|
| | | | Feed | Refined | Revs (1000) |
| 20a | A | Fractionated | 85 | 15 | 5 |
| 20a | B | Fractionated | 85 | 15 | 10 |
| 20a | C | Fractionated | 70 | 30 | 3 |
| 20a | D | Fractionated | 70 | 30 | 4 |
| 20a | E | Fractionated | 70 | 30 | 5 |
| 20b | F | Unfractionated | 75 | 25 (Feed) | 5 |
| 20a | G | Fractionated | 75 | 25 | 10 |
| 20a | H | Fractionated | 75 | 25 | 10 |
| Conventional | I | Unfractionated | - | 100 | 0 |
| Conventional | J | Unfractionated | - | 100 | 1 |
| Conventional | K | Unfractionated | - | 100 | 2.5 |
| Conventional | L | Unfractionated | - | 100 | 5 |
| Conventional | M | Unfractionated | - | 100 | 7.5 |

Figure 17

Exemplary Paper Strength Using New System

SYSTEM FOR ENGINEERING FIBERS TO IMPROVE PAPER PRODUCTION

RELATED APPLICATIONS

This application claims the benefit of priority of U.S. Provisional Patent Application No. 62/208,355, filed Aug. 21, 2015, which is herein incorporated by reference.

FIELD

The present invention generally relates to a system for making paper from cellulosic fibers. More specifically, it relates to a system that engineers the cellulosic fibers to improve paper quality and reduce paper production costs.

BACKGROUND

Paper, board and tissue are made from pulp that includes cellulosic fibers originally processed from wood chips. These chips are process mechanically or chemically to liberate the fibers from the fiber/lignin structure. Liberated fibers are usually bleached and refined as a single slurry before being formed and dried on a paper machine to make reels of paper. Softwood and hardwood fibers are usually processed separately until final blending just before paper machine processing.

Cellulosic fibers are a natural biological material derived from trees. As a biological material there is great diversity in fiber quality within one tree, let alone regionally and among different species. Current state of the art paper fabrication systems generally assume this diversity is a constant when transforming fibers into paper with the exception of distinguishing between softwood and hardwood fibers. In order to accommodate this assumption, large operating safety margins are built into the paper making process. The assumption that all incoming fiber quality is constant limits the potential benefit of specific fibers in the overall distribution and also limits the flexibility of optimization within the overall process. For example, if one tries to improve sheet strength through refining then water removal will be adversely affected and vice versa. The ability to change paper properties independent of paper machine operation variables is restricted by the assumption that pulp is made up of fibers with constant quality.

The present invention aims to provide a new system for treating cellulosic fibers that improves upon the currently unresolved issues described above by allowing one to select out defined fiber distributions that can be independently processed and recombined to make a superior paper product at lower costs.

SUMMARY

In one implementation, the present disclosure is directed to a device for monitoring the interaction of fluid suspended cellulosic fibers being dynamically processed by a fractionator. The device is comprised of a vibration sensor and a vibration analyzer. The vibration sensor measures the vibration spectrum of the fractionator. The vibration analyzer determines vibration characteristics of the fractionator spectrum and compares the vibration characteristics to an acceptable characteristic; if the fractionator vibration characteristic is outside of a characteristic limit an alert signal is generated.

In another implementation, the present disclosure is directed to a system for measuring properties of fluid suspended cellulosic fibers. The system is comprised of a fractionator, a fractionator monitoring device and a vibration analyzer. The fractionator monitoring device includes a vibration sensor.

In another implementation, the present disclosure is directed to a system for engineering fiber properties of fluid suspended fibers, the fibers pass through primary, secondary, and/or tertiary fractionators to generate fractionated fiber slurries. Each fractionator has an incoming fractionable portion and produces a heavies fraction and a lights fraction. The system is comprised of an incoming fiber measurement device and a heavies fiber measurement device. The incoming fiber measurement device is interfaced to measure incoming fiber properties of the fractionable portion. The heavies fiber measurement device is interfaced to measure outgoing heavies fiber properties of a combination of the heavies fractions from the plurality of fractionators. Incoming fractionable fiber properties are compared to the combination of outgoing heavies fiber properties and a process parameter is adjusted to generate a targeted fiber property.

In yet another implementation, the present disclosure is directed to a system for engineering fiber properties of fluid suspended cellulosic fibers. The system is comprised of a plurality of fractionators that generate fractionated fiber slurries, each fractionator receiving an incoming fractionable portion with incoming fiber properties and incoming pressure and each fractionator producing a heavies fraction and a lights fraction. The heavies fraction having outgoing heavies fiber properties and an outgoing heavies pressure, flow and consistency. The lights fraction having outgoing lights fiber properties and an outgoing lights pressure, flow and consistency. The system also includes an incoming fiber measurement device interfaced to measure the incoming fiber properties of a combination of the incoming fractionable fiber portions. The system further includes a heavies fiber measurement device interfaced to measure outgoing heavies fiber properties of a combination of the heavies fractions from the plurality of fractionators. The incoming fiber properties are compared to the outgoing heavies fiber properties and the heavies pressure, flow or consistency is adjusted relative to the incoming pressure, flow or consistency to optimize the outgoing heavies fiber properties.

In yet another implementation, the present disclosure is directed to a system for engineering cellulosic fibers suspended in a fluid that has been split into an original portion and a fractionable portion. The system is comprised of a fractionator to factionate the cellulosic fibers of the fractionable portion into a heavies fraction and a lights fraction. The system also comprises a refiner to refine the heavies fraction into a refined heavies fraction. The system further comprises a fiber property measurement system interfaced to measure cellulosic fiber properties of the cellulosic fibers. Measured cellulosic fiber properties are then used to determine an amount of said refined heavies fraction to be re-combined with the lights fraction and original portion to construct a recombined slurry.

In still another implementation, the present disclosure is directed to a system for engineering cellulosic fibers suspended in a fluid that has been split into an original portion and a refinable portion. The system is comprised of a refiner to refine the refinable portion into a refined portion. The system further comprises a fiber property measurement system interfaced to measure cellulosic fiber properties of the cellulosic fibers. Measured cellulosic fiber properties are then used to determine an amount of said refined portion to be re-combined with the original portion to construct a recombined slurry that will produce an optimized paper product.

In still yet another implementation, the present disclosure is directed to a method of engineering cellulosic fibers. The method comprises first providing cellulosic fibers suspended in a fluid and a fractionator. The method then involves separating the cellulosic fibers into an original portion and a fractionable portion and introducing the fractionable portion of the cellulosic fibers into the fractionator. The method further involves separating the cellulosic fibers into a heavies fraction and a lights fraction and then refining the heavies fraction of cellulosic fibers into a refined heavies fraction to maximize bonding area. Finally the method involves recombining the refined fraction with at least one from the group consisting of the original portion and the lights fraction to create a recombined slurry.

BRIEF DESCRIPTION OF DRAWINGS

For the purposes of illustrating the invention, the drawings show aspects of one or more embodiments of the invention. However, it should be understood that the present invention is not limited to the precise arrangements and instrumentalities shown in the drawings, wherein:

FIG. 17 is a table indicating processing for several samples using the system shown in FIGS. 1 and 14 as compared to standard conventional processing.

DETAILED DESCRIPTION

The present invention embraces the biological variability of cellulosic fibers 18 (a.k.a. fiber) found in wood and provides a system 20 that uses this fiber variability to improve paper production and allow for new paper products to be produced with improved quality and reduced production costs. The way in which system 20 accomplishes this is by separating cellulosic fibers 18, then preferentially refining these separated fibers to a higher level of development than can now be achieved with the common practice where the full pulp flow is refined, and then blending back preferentially refined pulp to accommodate for fiber quality variations in the original pulp. Instead of adjusting refining, which is the current state of the art; paper makers will adjust blending to balance production output with respect to the type of paper and quality of paper. The resulting pulp mixture can be used to produce paper with various desired improved characteristics and reduced process costs.

Figure 1:
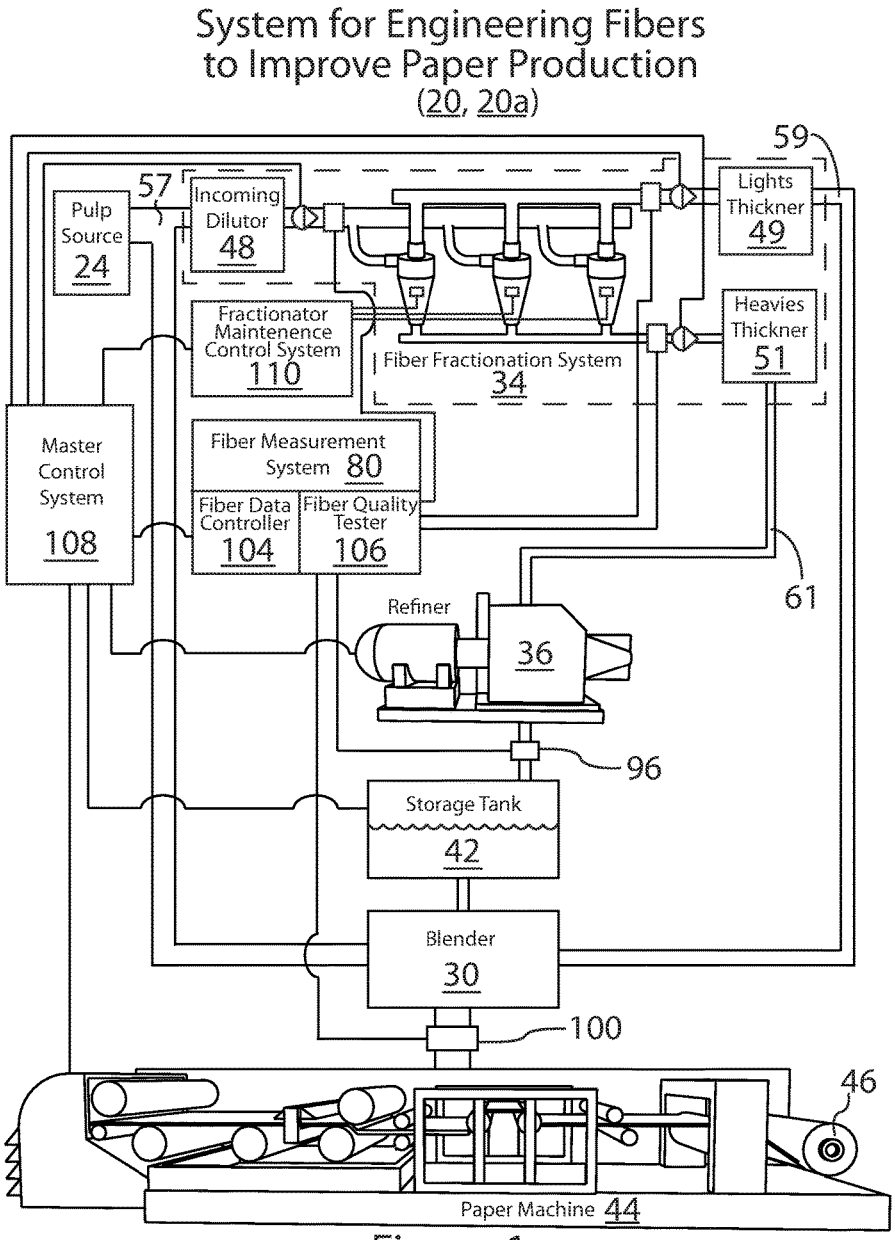
FIG. 1 is a schematic diagram of one exemplary deployment of the system for engineering fibers to improve paper production.

System 20 for engineering fibers to improve paper quality is illustrated in FIGS. 1-18. Cellulosic fibers 18 created from wood are generally suspended in a fluid such as water during processing. Suspended fibers along with the suspension fluid are generally known as a slurry. The slurry may also include additives such as defoamers, bonding agents, sizing agents, retention agents, drainage agents, fillers, enzymes, etc. System 20 (20*a* and 20*b*), FIGS. 1 and 14 comprises incoming fibers (a.k.a. original fibers 18*a*) as original slurry 22 obtained from a pulp source 24. In one embodiment, FIG. 20*a*, original slurry 22 (a.k.a. feed or feed pulp) is then split between a fractionable portion 26 and the remaining original portion 28. Remaining original portion 28 is directed to blender 30. Fractionable portion 26 is then processed by fiber fractionation system 34. Here fibers 18 are separated by a given fiber property/characteristic, such as fiber wall thickness, fiber density, fiber size, etc. One fraction, unrefined portion 38, is sent to blender 30 while the other portion to be refined is sent to refiner 36 where fibers 18 are refined to create a refined portion 40. Refined fibers 18*d* are held in storage tank 42. Varying amounts of refined portion 40, non-refined portion 38 and original portion 28 are then blended together in blender 30 to produce optimized slurry 39 with optimal characteristics to be processed by paper machine 44 and create an optimized paper product 46. For example, the cellulosic fibers may have the same or increased bonding area with better drainage or the optimized cellulosic product may have increased strength while maintaining bulk, caliper and stiffness. Although the word "paper" is used as a modifier throughout this disclosure as in "paper machine" and also as an example of an end product that can be fabricated with system 20, it should be understood that the use of the word "paper" is meant to also include board, tissue and all other paper products.

Fiber fractionation system 34 may be any type of system that can separate cellulosic fibers 18 based on a fiber property. Fiber properties may include fiber wall thickness, fiber density, fiber size (length, width), fiber shape, amount of crill/nanofibrils (total, attached, unattached), fines content, etc. In one embodiment fiber fractionation system 34*a* is a bank of hydrocyclones 50 connected in parallel, FIG. 2*a*. In another embodiment fiber fractionation system 34*b* may include hydrocyclones 50 in series to create primary, secondary, and/or tertiary banks in series, FIG. 2*b*. In FIG. 2*b* arrows indicate direction of flow. Fractionators may also be screens, differential belt washers, flotation devices, etc. Hydrocyclones 50 each separate cellulosic fibers 18 based on at least one from the group including fiber wall thickness and fiber size. Connecting multiple hydrocyclones 50 in parallel allows for greater throughputs as each hydrocyclone can only process a limited flow rate.

Figure 2A:
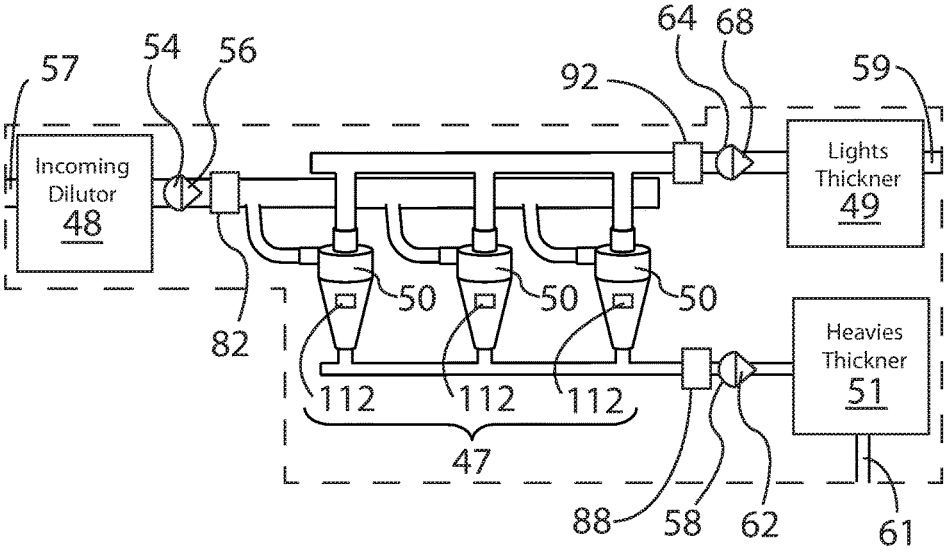
FIG. 2*a* is a schematic diagram of one embodiment of the fiber fractionation system shown in FIG. 1.
Figure 2B:
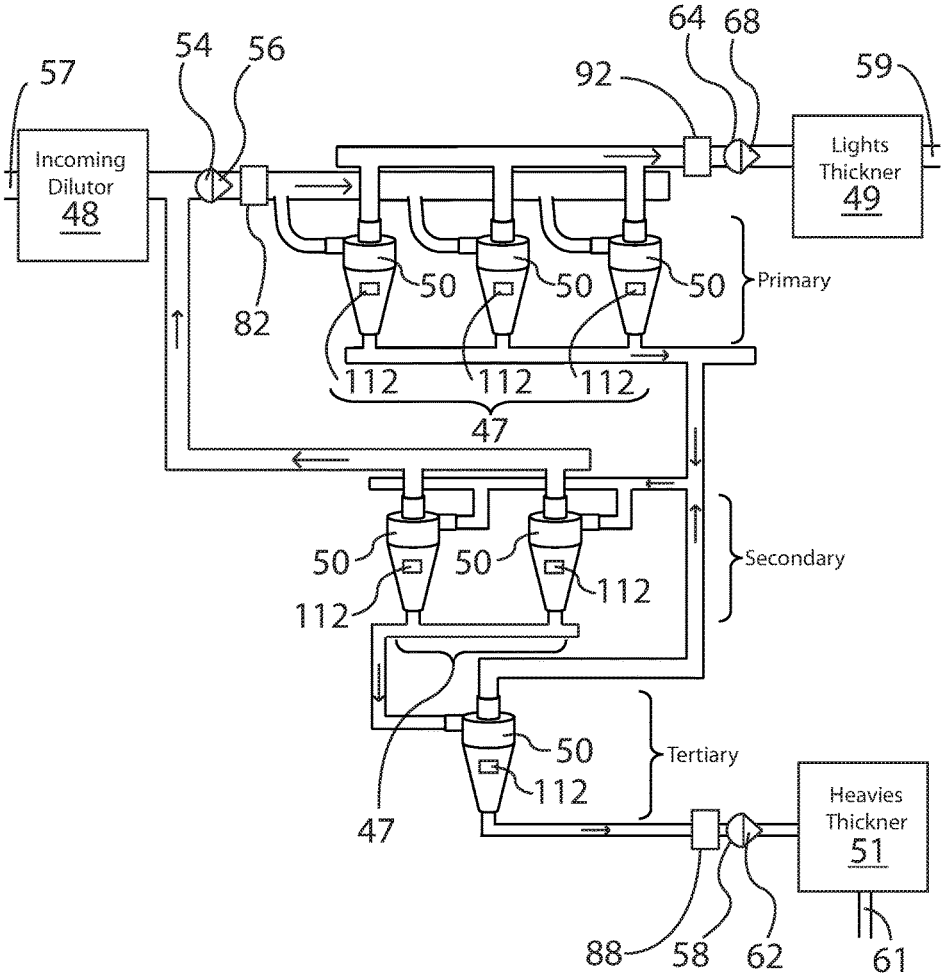
FIG. 2*b* is a schematic diagram of an alternative embodiment of the fiber fractionation system shown in FIG. 2*a*, now having primary, secondary and tertiary fractionators.

Fiber fractionation system 34 (34*a* and 34*b*), FIGS. 2*a* and 2*b*, may have additional components that aid in the process of fractionation. For example, an incoming diluter 48 may be used to adjust the fluid content of the fractionable portion 26 of the slurry before it enters hydrocyclone bank 47. A lights thickener 49 may be used to adjust the fluid content of the lights fraction 53 exiting fiber fractionation system 34. A heavies thickener 51 may be used to adjust the fluid content of the heavies fraction 55 exiting fiber fractionation system 34. Additionally pressure meters, mass flow meters, and consistency meters may be integrated to measure pressure, flow and consistency of the slurry as it enters the fiber fractionation system at fiber fractionation system inlet 57 and exits as one or more of the fractionated portions 53 and/or 55 at either lights outlet 59 or heavies outlet 61. Consistency is defined as the percent solids content in a slurry. Incoming pressure meter 54 measures incoming pressure of fractionable portion 26 to all fractionators. Incoming flow meter 56 measures a combination of incoming flow rates of fractionable portion 26 flowing into all fractionators. Heavies pressure meter 58, if present, measures outgoing heavies pressure of the heavies fraction 55. Heavies flow meter 62, if present, measures a combination of outgoing flowing rates of the heavies fraction 55 flowing from all fractionators. Incoming consistency is measured by fiber measurement system 80 as a combination of incoming consistency of fractionable portion 26 flowing into all fractions. Lights pressure meter 64 measures outgoing lights pressure of the lights fraction 53. Lights flow meter 68 measures a combination of outgoing flow rates of the lights fraction 53 flowing from all fractionators. Lights consistency is measured as outgoing lights consistency of lights fraction 53. Incoming pressure and consistency, outgoing heavies pressure and outgoing lights pressure can be adjusted relative to each other to regulate flow rates and the degree of fractionation desired.

Figure 3:
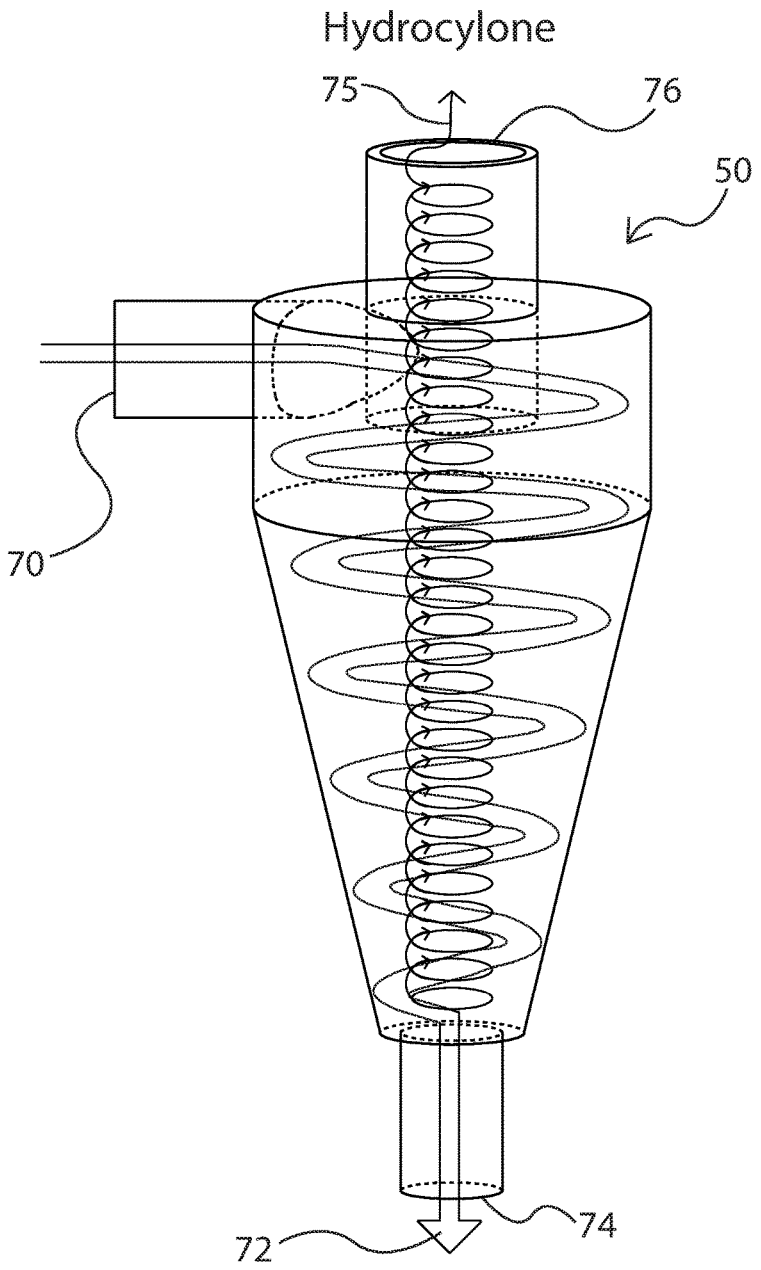
FIG. 3 is a schematic view diagraming the internal working of a hydrocyclone fractionator used in the system of FIGS. 2*a* and 2*b;*

Each hydrocyclone 50 works as shown in FIG. 3. Incoming slurry is fed under pressure through fractionator inlet 70. Fractionator inlet 70 is offset to one side of hydrocyclone 50. The slurry spins in a downward spiral towards the outer walls of hydrocyclone 50 as depicted by heavies flow arrow 72. Thicker, heavy fibers 18*c* drift outwards towards the walls of hydrocyclone 50 and exit through the bottom heavies fractionator outlet 74. Lighter fibers 18*b* and fines drift towards the center of hydrocyclone 50 and spin centrally upwards as depicted by lights flow arrow 75. Fines are defined as fiber components that can pass through a 200-mesh Bauer McNett screen. These lighter fibers 18*b* and fines spiral upward exiting through the top lights fractionator outlet 76.

In one embodiment fiber fractionation system 34 operates as follows. Each fractionator receives incoming fractionable portion with incoming fibers properties, incoming pressure, and incoming consistency. The fractionators then generates fractionated fibers slurries. Each fractionator produces a heavies fraction and a lights fraction. The heavies fraction has outgoing fiber properties, outgoing pressure and outgoing consistency. The lights fraction has outgoing lights fiber properties, outgoing lights pressure and outgoing lights consistency. An incoming fiber measurement device is interfaced to measure the incoming fiber properties of a combination of said incoming fractionable fiber portions. A heavies fiber measurement device may be interfaced to measure outgoing heavies fiber properties of a combination of the heavies fractions from the plurality of fractionators. The incoming fiber properties are compared to the outgoing heavies fiber properties and for example the heavies pressure is adjusted relative to the incoming pressure to optimize the outgoing heavies fiber properties and to control fractionation efficiency.

Figure 4A:
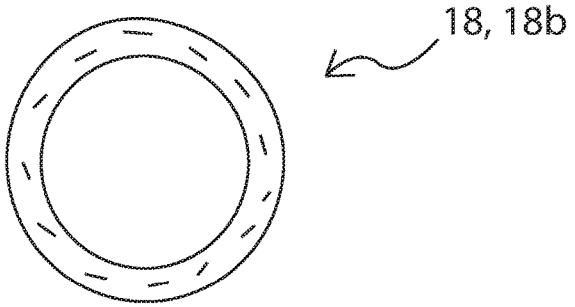
FIG. 4*a* is a schematic, sectional view of a thin walled cellulosic fiber before treatment by the system of FIG. 1.
Figure 4B:
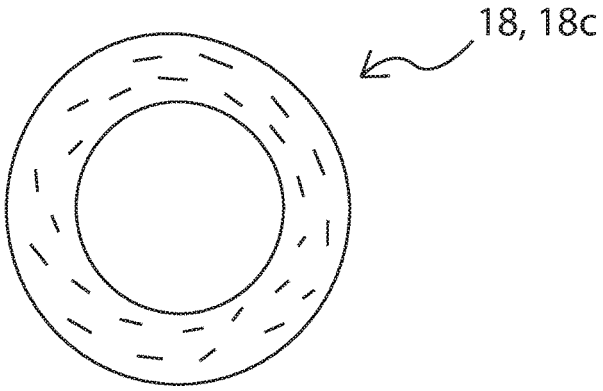
FIG. 4*b* is a schematic, sectional view of a thick walled cellulosic fiber before treatment by the system of FIG. 1.
Figure 5A:
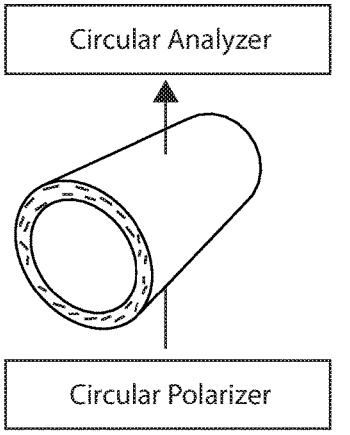
FIG. 5*a* is a diagram illustrating one technique for measuring fiber wall thickness of fibers processed by the system of FIG. 1.
Figure 5B:
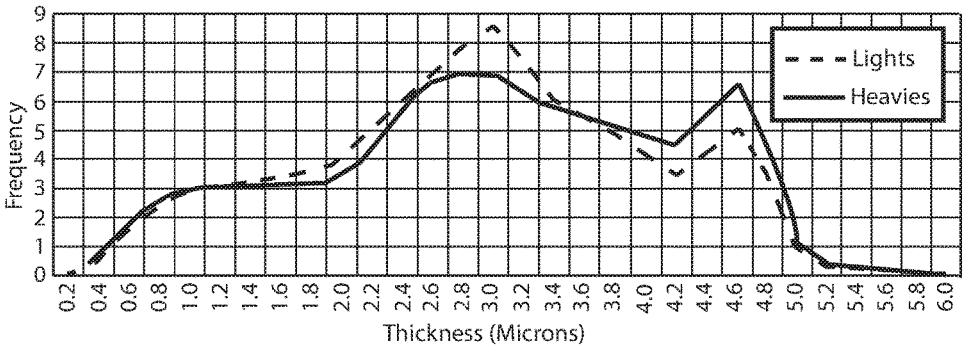
FIG. 5*b* is a graph of exemplary fiber wall thickness distribution for pulp after processing through the fiber fractionation system of the system of FIG. 1.

FIGS. 4*a* and 4*b* depict cross-sections of a thin walled, light fiber 18*b* (a.k.a. lights) and a thick walled, heavy fiber 18*c* (a.k.a. heavies). The thicker the wall of fiber 18, the more weight the fiber has and the more likely to exit the bottom heavies fractionator outlet 74. The thinner the wall of fiber 18, the less weight the fiber has and the more likely to exit top lights fractionator outlet 76. Fiber wall thickness may be measured by red green blue (RGB) circular polarized light as shown in FIG. 5*a* and taught in U.S. Pat. No. 7,289,210, which is herein incorporated by reference. FIG. 5*b* shows exemplary data where fiber wall thickness has shifted after fractionation.

Figure 6A:
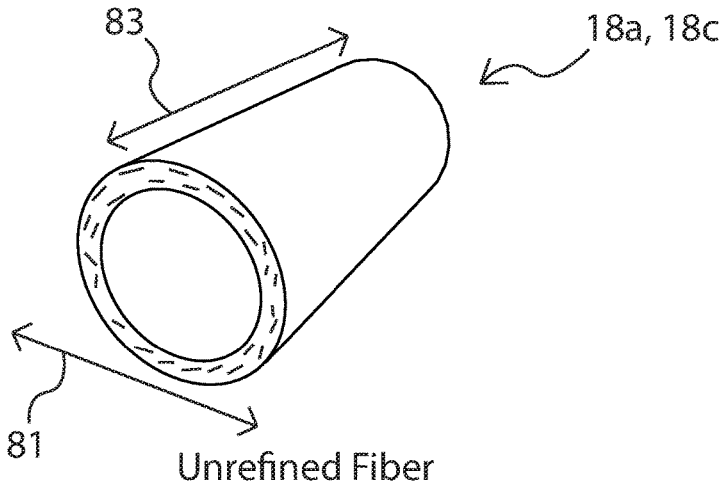
FIG. 6*a* is a schematic, perspective view of an unrefined fiber before treatment by the system of FIG. 1.
Figure 6B:
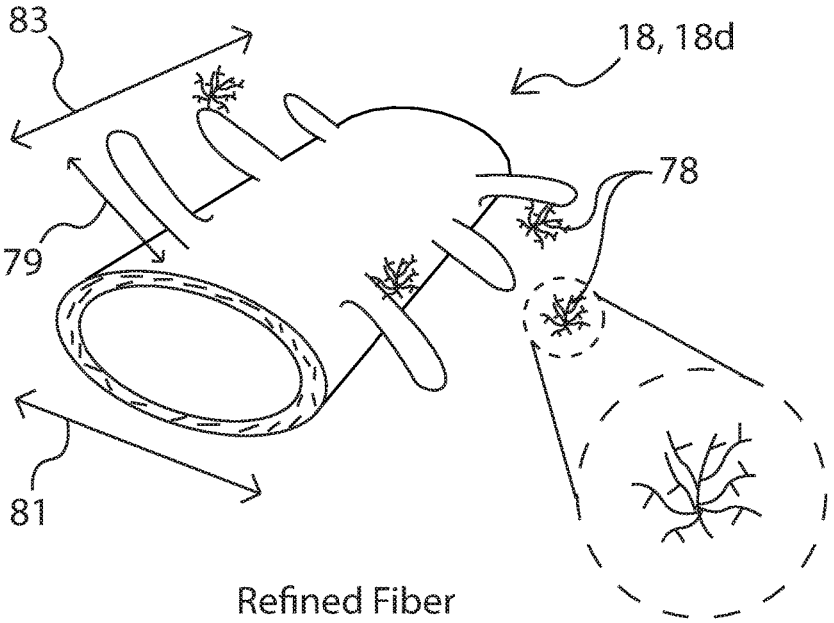
FIG. 6*b* is a schematic, perspective view of the cellulosic fiber of FIG. 6*a*, after one possible treatment step to the fiber is completed as part of the system of FIG. 1.
Figures 7A, 7B:
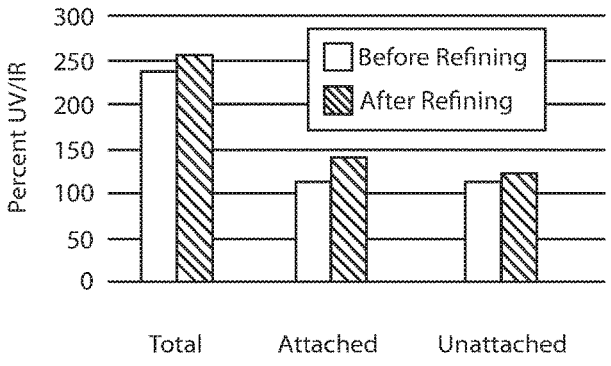
FIG. 7*a* is a diagram illustrating one technique for measuring fiber crill for fibers processed by the system of FIG. 1.
FIG. 7*b* is a graph of exemplary crill properties for pulp before and after processing through the refiner of the system of FIG. 1.

Refinement of fibers 18 can be used to modify fiber components contained within the slurry. Refining is the development of a fiber to generate more surface area through mechanical, chemical or biological processing. FIGS. 6*a* and 6*b* schematically show the fiber components of crill/nanofibrils 78, macrofibrils 79, fiber width 81 and fiber length 83 before and after refinement. Generally these cellulosic components are sized as follows: crill/nanofibrils 78 (having lengths of 0.1-1 micron), macrofibrils 79 (having lengths of 1-20 microns), fiber widths 81 (20-microns to 1-millimeter) and fiber lengths 83 (1-5 millimeters). Other engineering or refinement of fibers 18 may include deflaking, deshiving or fiberizing. A fiber property such as the amount of crill 78 (total, attached and unattached) determines the bonding surface area of fiber 18 and directly relates to the strength of the paper. A larger percentage of crill 78, both attached and unattached also affects the speed of drying of paper, board and tissue and can affect the amount of energy and time required to make the paper, board and tissue and adversely affecting paper production costs. A thick walled or heavy unrefined original fiber 18*a* in cross-section is depicted in FIG. 6*a*. After refinement through refiner 36, the refined fiber 18*d* in cross-section will be deformed and have more crill 78 (total, attached and unattached) as shown in FIG. 6*b*. Crill (total, attached and unattached) is cellulosic material in the nanofibril size range and is measured by the ratio of UV light absorption to IR light absorption as shown in FIG. 7*a* and taught in U.S. Pat. No. 4,514,257, which is herein incorporated by reference. Light is projected through the cellulose fiber components and scatter is recorded. Crill is calculated by the relationship between the scatter generated by UV versus IR light, where UV light scatters the nanofibrils (crill). FIG. 7*b* shows representative crill bonding area data before and after refining.

Figure 8:
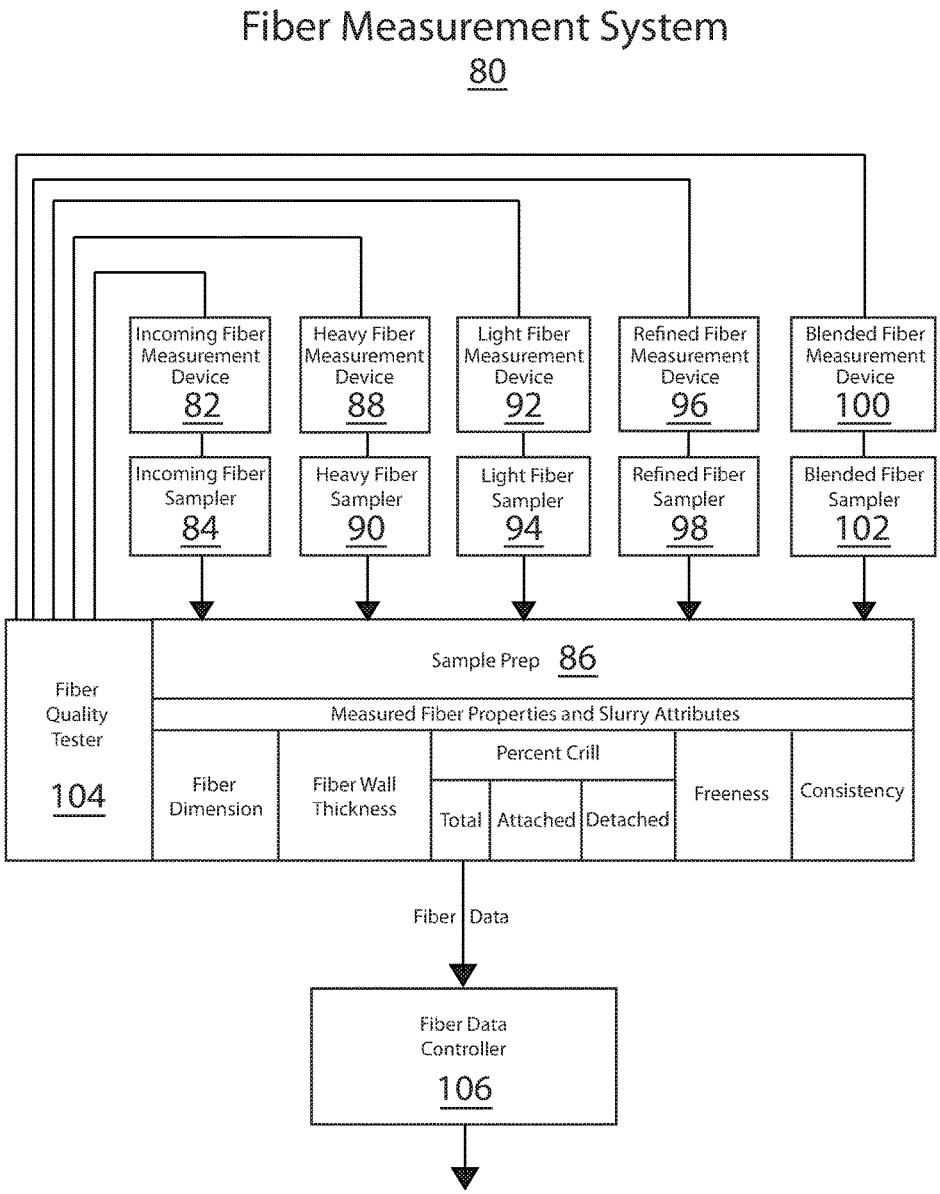
FIG. 8 is a schematic diagram of the fiber measurement system of the system shown in FIG. 1.

Fiber measurement system 80, FIG. 8, includes one or more fiber measurement devices. Although many fiber measurement devices are shown with fiber quality tester 104 testing many properties of the fiber, it should be understood that only a select few of the fiber measurement devices and properties may actually be implemented in any system 20 depending on what the final paper product to be manufactured requires. Fiber measurement system 80 may include incoming fiber measurement device 82. Incoming fiber measurement device 82 is interfaced to measure incoming fiber properties of the fractionable portion 26 and includes an incoming sampler 84. Fiber sampled from incoming fiber sampler 84 is directed to sample prep 86. Fiber measurement system 80 may include heavy fiber measurement device 88. Heavy fiber measurement device 88 is interfaced to measure outgoing heavies fiber properties of a combination of the heavies fractions from a plurality of fractionators and includes a heavy fiber sampler 90. Fiber sampled from heavy fiber sampler 90 is directed to sample prep 86. Fiber measurement system 80 may include light fiber measurement device 92. Light fiber measurement device 92 includes a light fiber sampler 94. Fiber sampled from light fiber sampler 94 is directed to sample prep 86. Fiber measurement system 80 may include refined fiber measurement device 96. Refined fiber measurement device 96 includes a refined fiber sampler 98. Fiber sampled from refined fiber sampler 98 is directed to sample prep 86. Fiber measurement system 80 may include blended fiber measurement device 96. Blended fiber measurement device 100 includes a blended fiber sampler 102. Fiber sampled from blended fiber sampler 102 is directed to sample prep 86. Individual fiber samples prepared by sample prep 86 are then each tested for one or more fiber properties or slurry attributes such as fiber dimensions (length and width), fines content, fiber wall thickness, percent crill (total, attached, detached), freeness, consistency, pH, etc. Sample prep 86 and the tests that follow for each fiber property make up the fiber quality tester 104. A fiber data controller 106 is integrated with fiber quality tester 106 to send appropriate fiber data to master control system 108.

In one embodiment fiber measurement system 80 is used to compare incoming fractionable fiber properties to a combination of outgoing heavies properties and then use this result to adjust process parameters to achieve a targeted fiber property. In another embodiment fiber measurement system 80 is used to compare incoming fractionable fiber properties to a combination of outgoing lights properties and then use this result to adjust process parameters to achieve a targeted fiber property.

Figure 9:
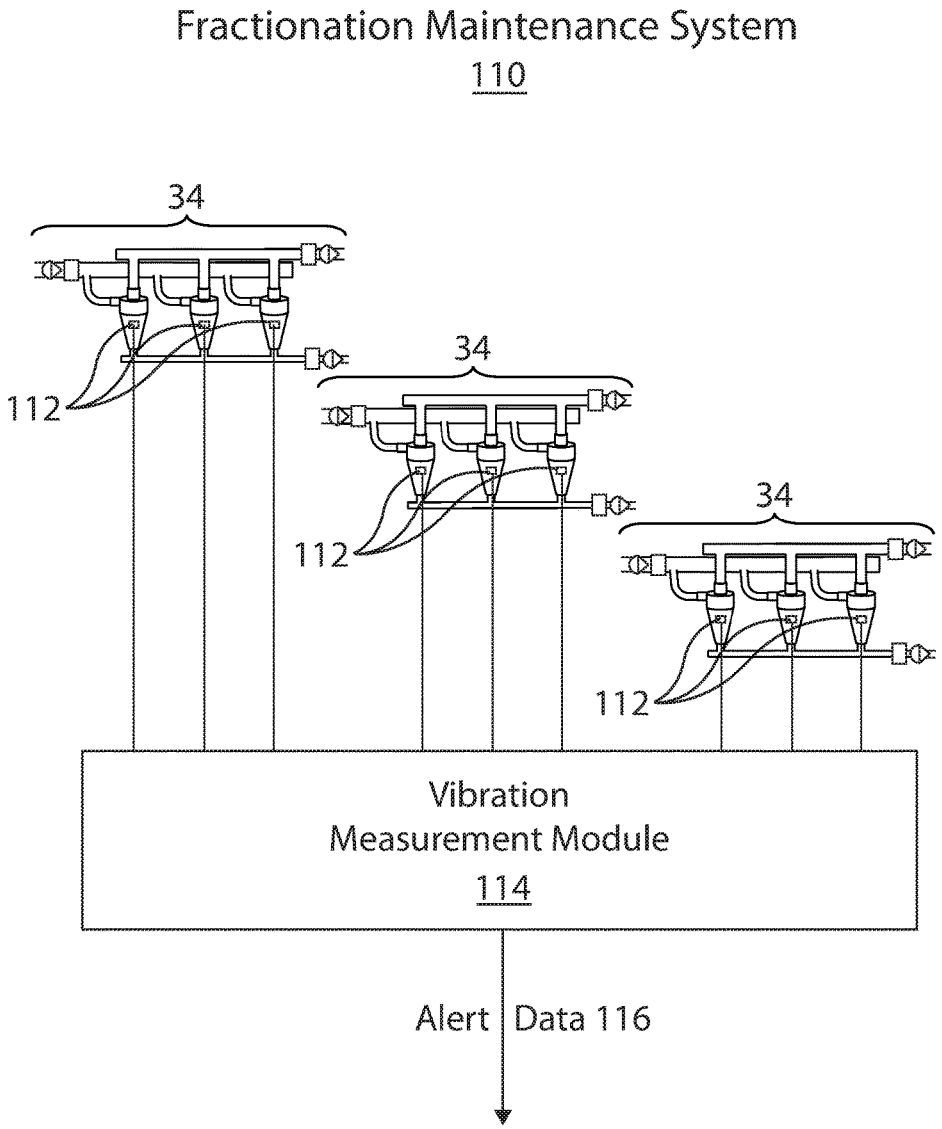
FIG. 9 is a schematic diagram of the fractionation maintenance system of the system shown in FIG. 1.
Figure 10:
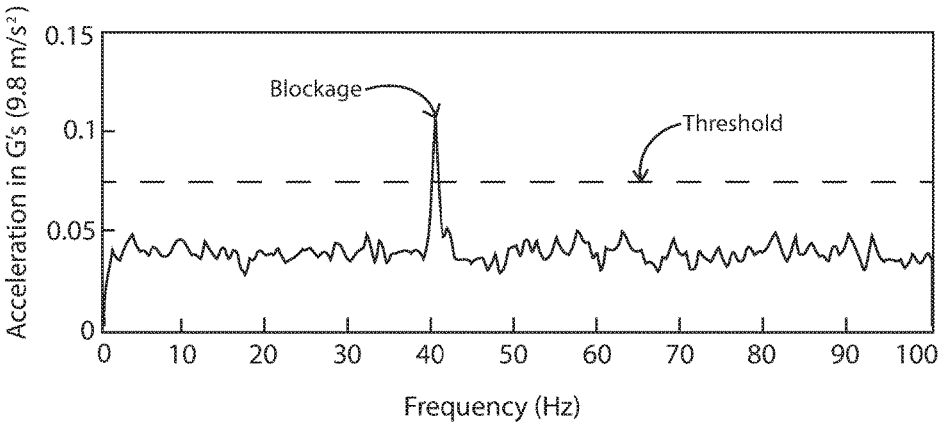
FIG. 10 is a plot of vibration spectra and a specific vibration characteristic that may be measured from the vibration sensor shown in FIG. 9.
Figure 11:
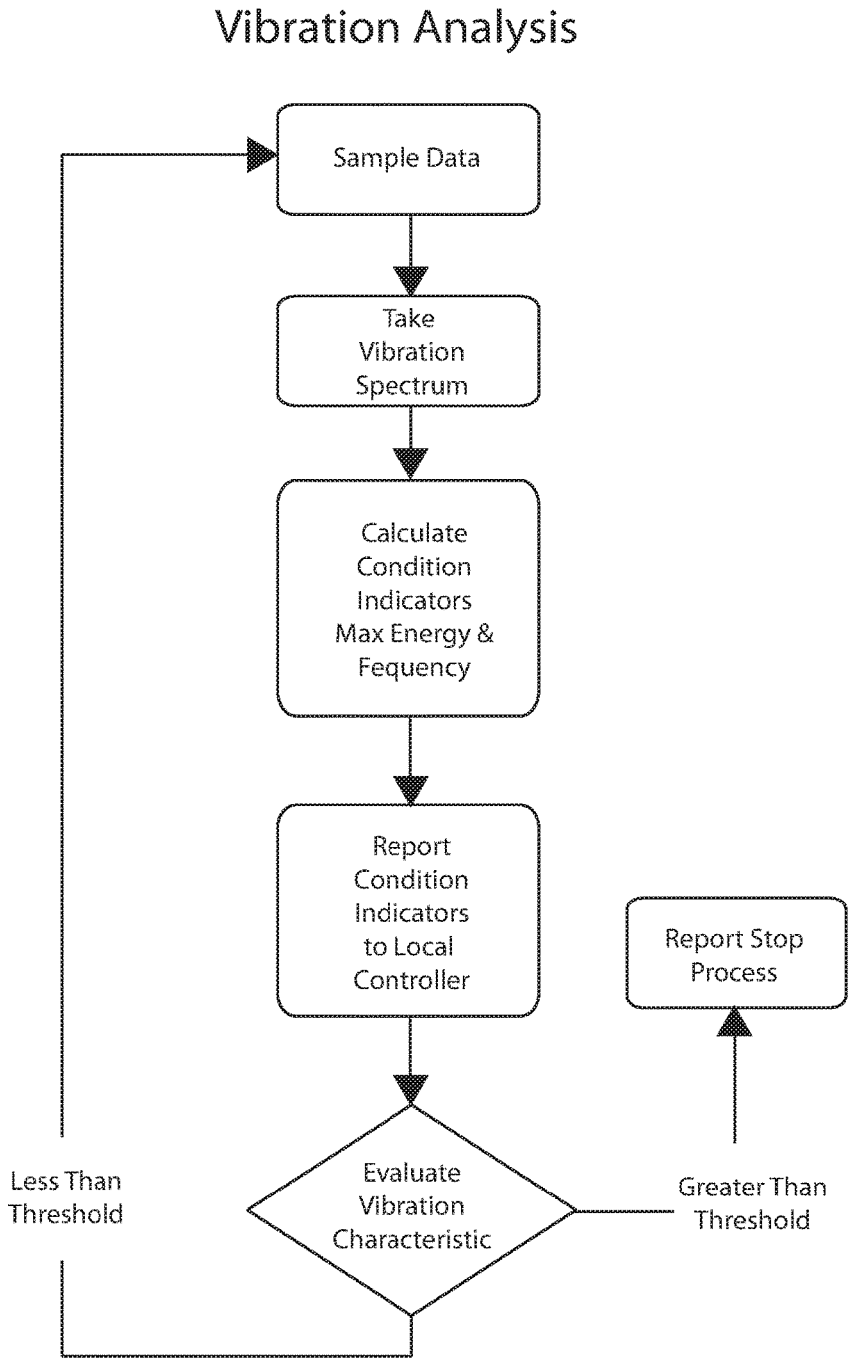
FIG. 11 is a flowchart of how the vibration spectra and vibration characteristic shown in FIG. 10 may be used to produce an alert in conjunction with the fractionation maintenance system of FIG. 9.

System 20 may include a fraction maintenance system 110, FIG. 9. Fraction maintenance system 110 includes a fractionator monitoring device 112 interfaced with one or more fractionators to monitor operation of the fractionator. When fractionating by weight of fibers the fractionator is preferably a hydrocyclone 50. Fractionator monitoring device 112 includes a vibration sensor. The vibration sensor measures the vibration spectrum of the fractionator. One example of a vibration spectra showing a vibration characteristic indicating a blockage within a hydrocyclone is shown in FIG. 10. A vibration analyzer, FIG. 11, determines vibration characteristics of the fractionator vibration spectrum and compares the vibration characteristics to an acceptable characteristic in vibration measurement module 114. If the fractionator vibration characteristics are outside of a characteristic limit (a.k.a. threshold) an alert is signaled. Alert data 116 is transmitted to master control system 108.

Fiber data controller 104 receives fiber data and uses that data for overall control of system 20 through master control system 108. Master control system 108 adjusts incoming pressure, incoming consistency, outgoing heavies pressure and outgoing lights pressure to regulate flow rates and the degree of fractionation desired. Master control system 108 also regulates refiner 36 to refine heavies fraction 55 to the appropriate level of refining. Master control system 108 further regulates the amount of refined fiber stored in storage tank 42. Master control system 108 also regulates how original unrefined fiber 18*a*, refined fiber 18*d* and possibly additionally fractionated unrefined fiber is blended in blender 30 to produce an optimized slurry with optimal characteristics to be processed by paper machine 44 to create an optimized paper, board or tissue products 46. Master control system 108 also receives fractionator alert data 116 and sends out alerts to keep fiber fractionator system 34 in optimal working condition.

Figure 12:
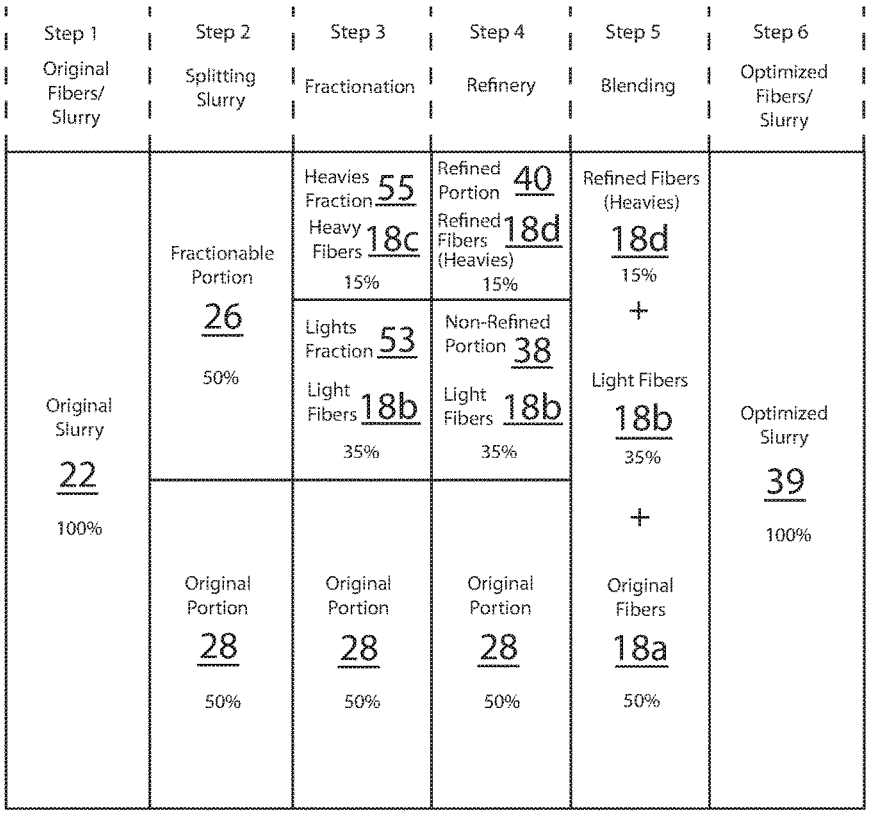
FIG. 12 is an exemplary process flow diagram for one embodiment of processing cellulosic fibers in conjunction with the system of FIG. 1.

In one embodiment, system 20, 20*a*, is used in a static mode where the amount of fiber flowing through each portion of the system is a constant pre-determined amount. FIG. 12 illustrates step-by-step processing for such an embodiment showing the amount of fiber flow in each portion of system 20. When operating in this mode, previous experimental data is used to predetermine what the fiber flow will be through each portion of system 20. In step 1—100-percent of original fibers 18*a* suspended in a fluid enters the system as original slurry. Step 2—the slurry is split. 50-percent goes to fiber fractionation system 34 as fractionable portion 26 and the other 50-percent (original portion 28) is redirected to blender 30. Step 3—fractionation occurs. The fractionable portion 26 is introduced into the fractionators and is separated/fractionated by the fractionators into 15-percent heavy fibers 18*c* (heavies fraction 55) and 35-percent light fibers 18*b* (lights fraction 53). The 35-percent lights fraction is directed to blender 30. Step 4—refining fibers to maximize bonding area, the 15-percent of heavies fibers is directed to and processed by refiner 36. Step 5—blending the three fiber types: original fibers 18*a*, light fibers 18*b* and refined heavy fibers 18*d* are recombined and blended together. Step 6—the optimized slurry is achieved and sent to paper machine 44 to be turned into an optimized paper, board or tissue product 46. Percentages stated above are only for this one illustrative example; however these percentages should not be considered limiting and other percentages may be used.

Figure 13:
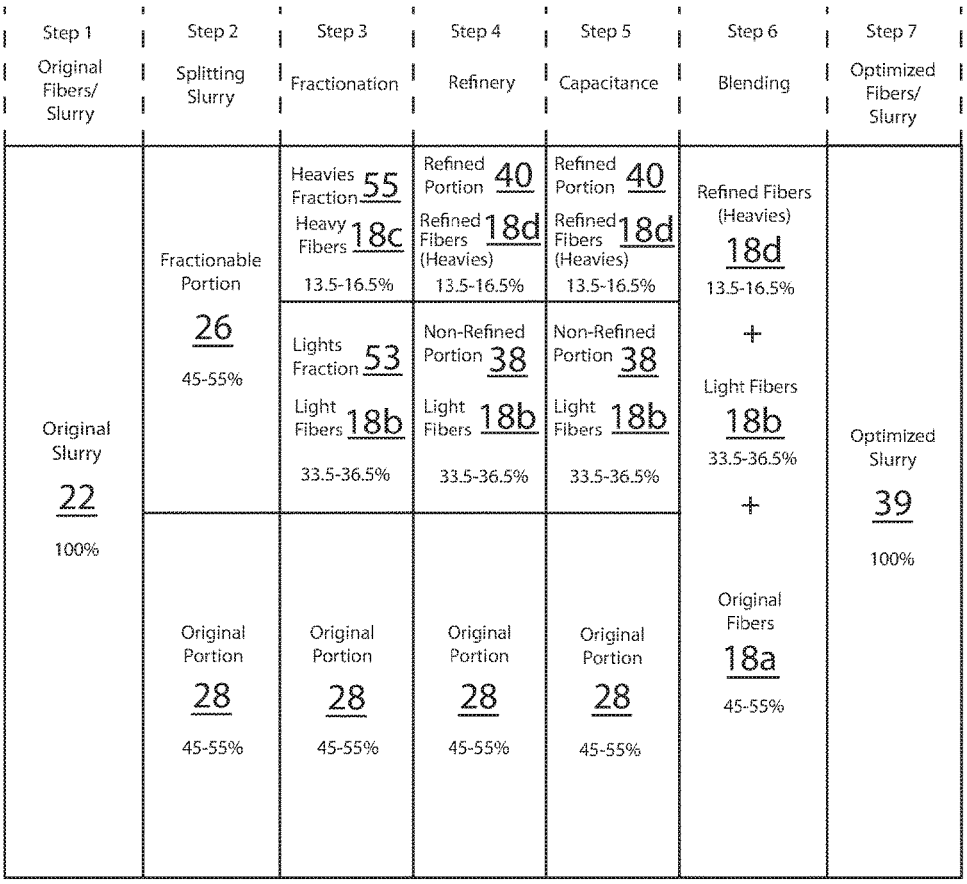
FIG. 13 is an exemplary process flow diagram for another embodiment of processing cellulosic fibers in conjunction with the system of FIG. 1.

In one embodiment system 20 is used in a dynamic mode where the amount of fiber flowing through each portion of the system is adjusted as measurements come in and are analyzed by master control system 108. FIG. 13 illustrates step-by-step processing for such an embodiment showing ranges for the amount of fiber flow in each portion of system 20 at any given time. In step 1—100-percent of original fibers 18*a* suspended in a fluid enters the system as original slurry. Step 2—the slurry is split within the given ranges depending on what type of paper is to be manufactured and feedback information gathered in the rest of the process flow. For example, fiber in the range of 45-55 percent goes to fiber fractionation system 34 as fractionable portion 26 and the other 45-55 percent (original portion 28) is redirected to blender 30. Step 3—fractionation occurs. The fractionable portion 26 is introduced into the fractionators and is separated/fractionated into 13.5-16.5 percent heavy fibers 18*c* (heavies fraction 55) and 33.5-36.5 percent light fibers 18*b* (lights fraction 53). The 33.5-36.5 percent lights fraction is directed to blender 30. Step 4—refining, the 13.5-16.5 percent of heavies is directed to and processed by refiner 36. Step 5—capacitance involves storing the fiber and then drawing upon the stored fibers as needed to mix the ideal fiber composition. Step 6—blending the three fiber types: original fibers 18*a*, light fibers 18*b* and refined heavy fibers 18*d* are recombined and blended together in any percentage that is required to produce the optimized slurry. Step 7—the optimized slurry is achieved and sent to paper machine 44 to be turned into an optimized paper, board or tissue product 46. Percentages stated above are only for this one illustrative example; however these percentages should not be considered limiting and other percentages may be used.

Figure 14:
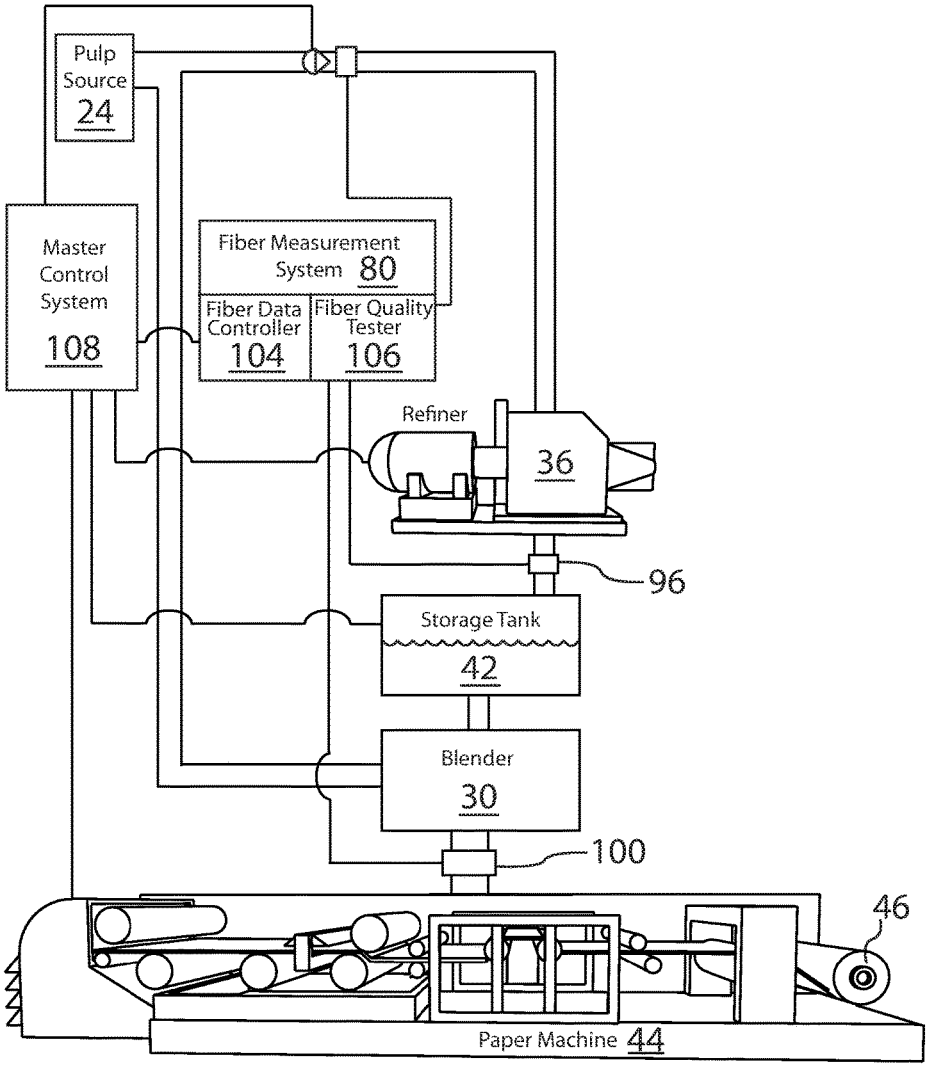
FIG. 14 is a schematic diagram of another exemplary deployment of the system for engineering fibers to improve paper production.

In an alternative embodiment, FIG. 14, system 20, 20*a* has been modified to remove fiber fractionation system 34 and fractionator maintenance control system 110 giving a modified system as shown in system 20, 20*b*. In system 20*b*, cellulosic fibers 18 are split into a refinable portion 60 and the remaining original portion 28. Remaining original portion 28 is directed to blender 30. Fibers 18 from refinable portion 60 are then refined into refine portion 40. Refined fibers 18*d* are held in storage tank 42. Varying amounts of refined portion 40 and original portion 28 are then blended together in blender 30 to produce optimized slurry 39 with optimal characteristics to be processed by paper machine 44 and create an optimized paper product 46.

Figure 15:
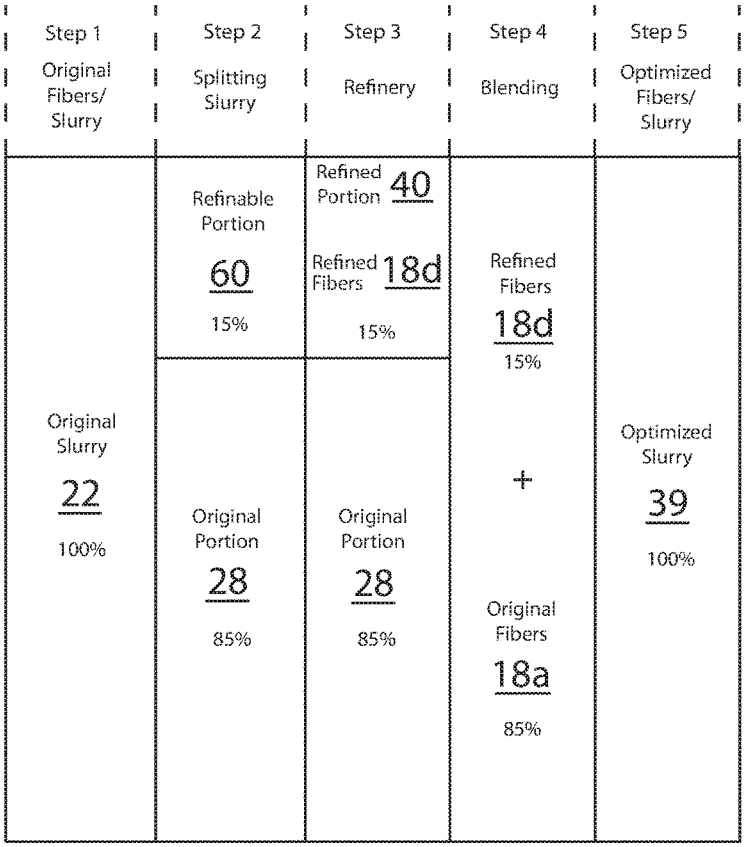
FIG. 15 is an exemplary process flow diagram for one embodiment of processing cellulosic fibers in conjunction with the system of FIG. 14.

In one embodiment, system 20, 20*b* is used in a static mode where the amount of fiber flowing through each portion of the system is a constant pre-determined amount. FIG. 15 illustrates step-by-step processing for such an embodiment showing the amount of fiber flow in each portion of system 20. When operating in this mode, previous experimental data is used to predetermine what the fiber flow will be through each portion of system 20. In step 1—100-percent of original fibers 18*a* suspended in a fluid enters the system as original slurry. Step 2—the slurry is split. 15-percent goes to refiner 36 as refinable portion 60 and the other 85-percent (original portion 28) is redirected to blender 30. Step 3—refining fibers to maximize bonding area, the 15-percent of refinable fibers is directed to and processed by refiner 36. Step 4—blending the two fiber types: original fibers 18*a* and refined fibers 18*d* are recombined and blended together. Step 5—the optimized slurry is achieved and sent to paper machine 44 to be turned into an optimized paper, board or tissue product 46. Percentages stated above are only for this one illustrative example; however these percentages should not be considered limiting and other percentages may be used.

Figure 16:
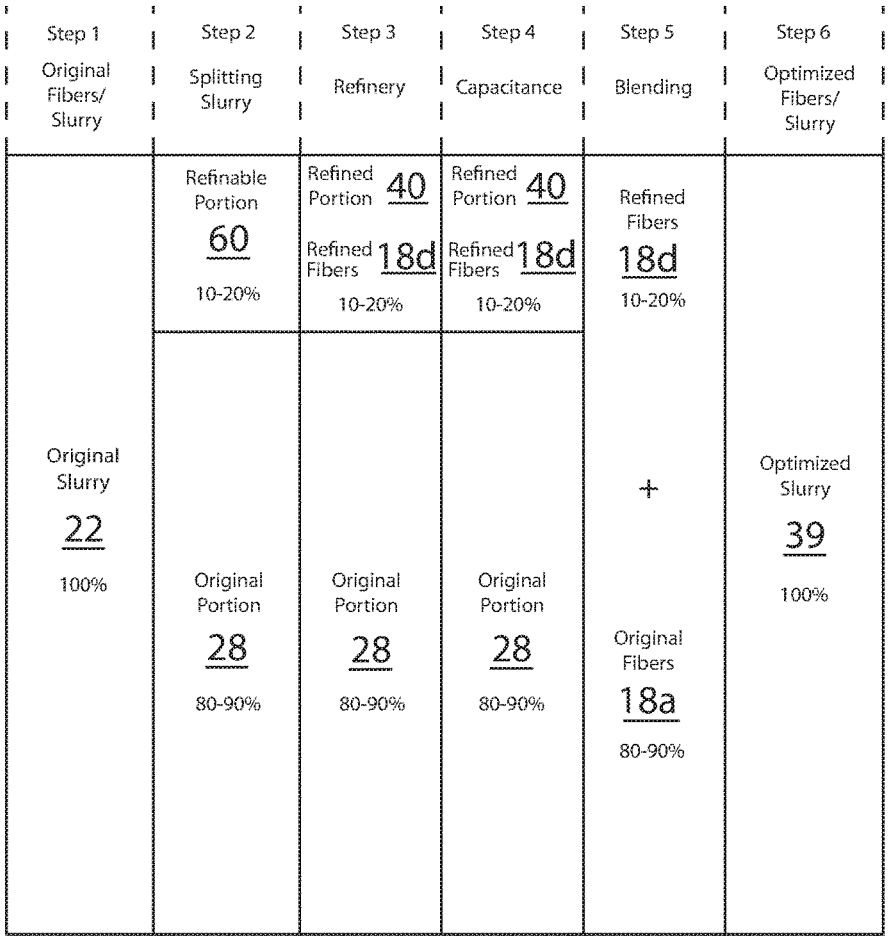
FIG. 16 is an exemplary process flow diagram for another embodiment of processing cellulosic fibers in conjunction with the system of FIG. 14.

In one embodiment, system 20, 20*b* is used in a dynamic mode where the amount of fiber flowing through each portion of the system is adjusted as measurements come in and are analyzed by master control system 108. FIG. 16 illustrates step-by-step processing for such an embodiment showing ranges for the amount of fiber flow in each portion of system 20 at any given time. In step 1—100-percent of original fibers 18*a* suspended in a fluid enters the system as original slurry. Step 2—the slurry is split within the given ranges depending on what type of paper is to be manufactured and feedback information gathered in the rest of the process flow. For example, fiber in the range of 10-20 percent goes to refiner 36 as a refinable portion 60 and the other 80-90 percent (original portion) is redirected to blender 30. Step 3—refining, the 10-20 percent of refinable portion is directed to and processed by refiner 36. Step 4—capacitance involves storing the fiber and then drawing upon the stored fibers as needed to mix the ideal fiber composition. Step 5—blending the two fiber types: original fibers 18*a* and refined fibers 18*d* are recombined and blended together in any percentage that is required to produce the optimized slurry. Step 6—the optimized slurry containing optimized fibers is achieved and sent to paper machine 44 to be turned into an optimized paper, board or tissue product 46. Percentages stated above are only for this one illustrative example; however these percentages should not be considered limiting and other percentages may be used.

FIG. 17 (Table 1) lists data for samples prepared in accordance with system 20 (20*a*, 20*b*) discussed in this disclosure and also for comparison samples that were prepared using standard conventional processing. Variables included whether fractionation occurred, the amount of feed and refined fibers combined, and the amount of refining the fibers were exposed to. For samples that were fractionated, a portion of feed slurry was fractionated at 0.5% TAPPI Standard T240 consistency. TAPPI® is a registered trademark of Technical Association of the Pulp and Paper Industry, Inc. Fractionated heavies were refined in a TAPPI standard T248 PFI mill at varying revolutions. Fractionated and refined heavies were blended back with feed slurry at varying percentages. TAPPI Standard T227 CSF drainage testing was performed on each blended slurry. TAPPI Standard T205 handsheets at 80 g/m$^2$ were generated. TAPPI Standard T822 Ring Crush Strength Testing was performed. For samples that were not fractionated (unfractionated), a portion of feed slurry was refined in a TAPPI standard T248 PFI mill at varying revolutions. Refined feed slurry was then blended back with unrefined feed slurry at 25%. TAPPI Standard T227 CSF drainage testing was performed on each blended slurry. TAPPI Standard T205 handsheets at 80 g/m2 were generated TAPPI Standard T822 Ring Crush Strength Testing was performed. For standard conventional processing, all feed slurry was refined in a TAPPI standard T248 PFI mill at varying revolutions. TAPPI Standard T227 CSF drainage testing was performed on each level of refining. TAPPI Standard T205 handsheets at 80 g/m2 were generated from sample from each level of refining. TAPPI Standard T822 Ring Crush Strength Testing was performed on all handsheets.

Figure 18:
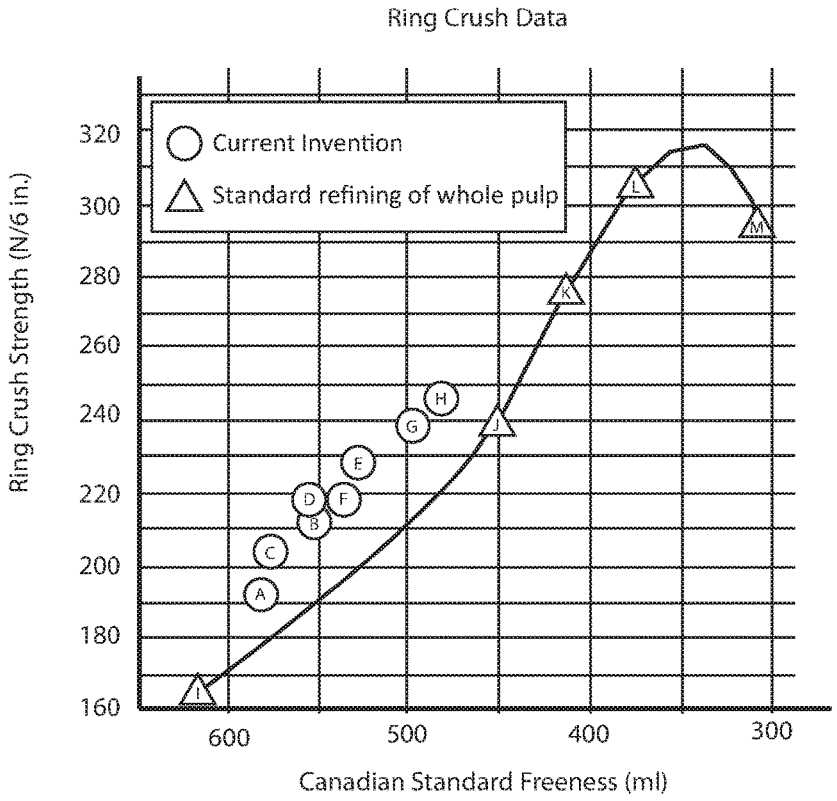
FIG. 18 is a plot of sample data from FIG. 17 comparing strength of paper prepared with the present invention against paper prepared with standard whole pulp refinement.

FIG. 18 shows a plot of the exemplary data for paper strength of the samples of FIG. 17 using standard refining practices and those practices outlined in this disclosure by the current invention associated with system (20, 20*a*, 20*b*). Triangular data points on the line are strength numbers of handsheets made from pulp using standard conventional refining practices. Circular data points are handsheet strength numbers made from pulp where highly refined fibers were blended with feed pulp at different blend percentages and refining levels. Paper strength was significantly increased using the system and method proposed by the current invention. TAPPI Standard T220 "beater curves", plotting strength of increasingly beaten pulp with freeness, were used to quantify the paper and board making strength potential for a given pulp sample. The comparison to be observed in FIG. 18 is the strength of new engineered paper according to the present invention with the TAPPI standard process. Obtaining higher strength at lower drainage levels is desirable as the easier it is for water removal at target strength, the greater the productivity (by increased production levels and with lower fiber usage). FIG. 18 shows refining heavies such that once blended back with original portion there is a step change of 5-15 percent higher ring crush strength at a target freeness (proxy for paper machine drainage) than when all fibers are refined. Refining has diminishing returns where increasing bonding levels are compromised by the break down in fiber structure. For the currently engineered fibers is it critical that only a portion of the fiber is refined. In this way it is possible to maximize bonding levels on that portion without compromising water removal or fiber structure. This is achieved in two ways, either by refining a portion of fractionated heavies or by refining a portion of the feed pulp. To get results A to H, which represents an average of 10% increase in strength at the same drainage as standard results, it is critical to blend either refined feed or refined fractionated heavies with feed pulp. These results cannot be achieved by conventionally refining of all feed pulp.

The advantages of system 20 is that instead of processing the fibers as a whole, a small portion of fibers with a specific fiber property can be separated out and only that fraction engineered by a mechanical or chemical process. For system 20*a*, three types of fibers (original, fractionated refined and fractionated non-refined) created by the system are then combined to create an optimum slurry to create optimized paper product 46. For system 20*b* two types of fibers (original and unfractionated refined) created by the system are then combined to create an optimum slurry to create optimized paper product 46. Cost savings are realized because only a small portion of the fibers have to go through special processing, e.g. refining to increase crill 78 (total, attached and unattached). Cost savings may also be realized as the final slurry may be optimized for drying and therefore require less time and energy to make optimized paper product 46. System 20 also has the advantage that a wide variety of specialty paper-products can be easily manufactured by having master control system 108 adjust fiber types and fiber amounts in situ as the paper mill adjust to different orders. Another advantage of the system 20 is that operating variance can be compensated with only blending changes and not both blending and refining changes. Still another advantage is that system 20 can reside in the pulp mill thus enhancing communication between pulp and paper machine personnel and minimizing paper machine personnel craft decision making.

While several embodiments of the invention, together with modifications thereof, have been described in detail herein and illustrated in the accompanying drawings, it will be evident that various further modifications are possible without departing from the scope of the invention. The scope of the claims should not be limited by the preferred embodiments set forth in the examples, but should be given the broadest interpretation consistent with the description as a whole.

What is claimed is:

1. A system for engineering fiber properties of incoming cellulosic fibers suspended in a fluid, comprising:

a) a fiber fractionation system inlet that splits incoming cellulosic fibers into an original portion and a fractionable portion, wherein said original portion and said fractionable portion have substantially the same composition;

b) a fractionator that receives said fractionable portion, said fractionator produces a heavies fraction and a lights fraction, said heavies fraction having outgoing heavies fibers with heavies fiber wall thickness, said lights fraction having outgoing lights fibers with lights fiber wall thickness;

c) a fiber measurement system interfaced to measure fiber wall thickness of said incoming cellulosic fibers and additionally at least one from the group consisting of said lights fiber wall thickness of said lights fraction and said heavies fiber wall thickness of said heavies fraction;

d) a refiner to refine said heavies fraction into refined heavies;

e) a refined fiber measurement device interfaced to measure fiber properties of said refined heavies; and f) wherein an amount of refined heavies is blended back with said original portion to create a recombined slurry for making a paper product.

2. A system as recited in claim 1, further comprising a fractionator monitoring device interfaced to measure fractionator vibrational characteristics within said fractionator.

3. A system as recited in claim 1, further comprising a storage tank that stores refined heavies.

4. A system as recited in claim 1, further comprising a blender that blends said original portion of incoming cellulosic fibers with said refined heavies.

5. A system as recited in claim 1, further comprising a blended fiber measurement device.

6. A system as recited in claim 1, wherein said fractionator is a plurality of fractionators.

7. A system as recited in claim 1, wherein said refined fiber measurement device measures crill bonding area.

8. A system as recited in claim 1, wherein said refined heavies provides all of the refined bonding area for a given paper product.

9. A system as recited in claim 1, further comprising a paper machine configured to make said paper product, wherein said paper product has a 5-15 percent ring crush strength improvement at a target freeness than when all incoming cellulosic fibers are refined together.

10. A system as recited in claim 1, wherein said system is configured to adjust the amount of refined heavies to maintain constant paper properties for said paper product.

11. A system as recited in claim 1, further comprising a blender that blends said original portion of incoming cellulosic fibers with said refined heavies and additionally an amount of said lights fibers to create said recombined slurry.

12. A system as recited in claim 6, further comprising a plurality of fractionator monitoring devices, wherein one fractionator monitoring device is interfaced with each fractionator.

13. A system as recited in claim 6, further comprising an incoming flow meter, wherein said incoming flow meter measures a combination of incoming flow rates flowing into all fractionators.

14. A system as recited in claim 6, further comprising an incoming pressure meter, wherein said incoming pressure meter measures incoming pressure to all fractionators.

15. A system as recited in claim 6, further comprising a lights flow meter, wherein said lights flow meter measures a combination of lights flow rates flowing from all fractionators.

16. A system as recited in claim 6, further comprising a lights pressure meter, wherein said lights pressure meter measures lights pressure from all fractionators.

17. A system as recited in claim 6, further comprising a fiber quality tester, wherein said fiber quality tester measures a combination of heavies consistency flowing from all fractionators.

18. A system as recited in claim 6, further comprising a fiber quality tester, wherein said fiber quality tester measures lights consistency from all fractionators.

19. A system for engineering cellulosic fibers suspended in a fluid, comprising:

a) a fiber fractionation system inlet that splits fibers from feed pulp into an original portion containing original fibers and a fractionable portion containing original fibers, wherein said original portion and said fractionable portion have substantially the same composition;

b) a fractionator to fractionate said original fibers of the fractionable portion into a heavies fraction having heavies fibers and a lights fraction having lights fibers;

c) a refiner to refine said heavies fraction into a refined heavies fraction containing refined fibers;

d) a fiber property measurement system interfaced to measure cellulosic fiber properties of said original fibers and refined fibers, and additionally at least one fiber property from the group consisting of said lights fraction and said heavies fraction; and e) wherein said measured cellulosic fiber properties are used to determine an amount of said refined heavies fraction to be re-combined with said original portion to construct a recombined slurry with optimized fibers for making a paper product.

20. A system as recited in claim 19, wherein said measured cellulosic fiber properties include at least one from the group consisting of fiber wall thickness, amount of crill and fines content that can pass through a 200-mesh Bauer McNett screen.

21. A system as recited in claim 19, wherein said fiber property measurement system includes an incoming fiber measurement device to measure original fiber wall thickness of said fractionable portion and a heavies fiber measurement device to measure heavies fiber wall thickness in said heavies fraction to control fractionation efficiency.

22. A system as recited in claim 19, further comprising a fractionator monitoring device interfaced with said fractionator to monitor operation of that fractionator.

23. A system as recited in claim 19, further comprising a refined fiber measurement device.

24. A system as recited in claim 19, further comprising a storage tank that stores refined fibers.

25. A system as recited in claim 19, further comprising a blender to blend said refined heavies fraction with said original portion.

26. A system as recited in claim 25, further comprising a blended fiber measurement device.

27. A system as recited in claim 19, further comprising a paper machine configured to produce at least one from the group consisting of paper, board, and tissue from said recombined slurry.

28. A system as recited in claim 19, wherein the system is configured to provide optimized fibers that have the same or increased bonding area with better drainage than a standard process where all original fibers are refined together.

29. A system as recited in claim 19, wherein the system is configured to produce an optimized cellulosic product using less fiber for a given ring crush strength than a paper product using a standard process where all original fibers are refined together.

30. A system as recited in claim 29, wherein said optimized cellulosic product has increased ring crush strength while maintaining bulk, caliper and stiffness of a paper product using a standard process where all original fibers are refined together.

31. A system as recited in claim 19, wherein the fluid is water.

32. A system as recited in claim 19, wherein the cellulosic fibers are wood fibers.

33. A system as recited in claim 19 wherein said fractionating device is a hydrocyclone.

34. A system as recited in claim 19, wherein said fractionating device fractionates by apparent fiber density.

35. A system as recited in claim 19, wherein said fractionating device fractionates by fines that pass through a 200-mesh Bauer McNett screen and fiber wall thickness.

36. A system as recited in claim 19, wherein said refined heavies provides all refined bonding area for a given paper product.

37. A system as recited in claim 19, wherein said recombined slurry provides for a paper product with constant paper properties.

38. A system as recited in claim 19, wherein said at least one fiber property of said lights fraction is lights fiber wall thickness.

39. A system as recited in claim 19, wherein said at least one fiber property of said heavies fraction is heavies fiber wall thickness.

40. A system as recited in claim 19, further comprising a paper machine configured to make said paper product, wherein said paper product has a 5-15 percent ring crush strength improvement at a target freeness than when all incoming cellulosic fibers are refined together.

41. A system as recited in claim 19, further comprising a blender that blends said original portion of incoming cellulosic fibers with said refined heavies and additionally an amount of said lights fraction to construct said recombined slurry.

* * * * *